United States Patent [19]

McDonald

[11] 4,085,078

[45] Apr. 18, 1978

[54] LOW VISCOSITY ASPHALT-RUBBER PAVING MATERIAL

[76] Inventor: Charles H. McDonald, 3130 W. Pierce St., Phoenix, Ariz. 85009

[21] Appl. No.: 754,446

[22] Filed: Dec. 27, 1976

[51] Int. Cl.[2] ..... C08L 95/00

[52] U.S. Cl. ..... 260/28.5 AS; 404/72

[58] Field of Search ..... 260/28.5 AS; 404/32, 404/72

[56] References Cited

U.S. PATENT DOCUMENTS

| | | | |
|---|---|---|---|
| 3,844,668 | 10/1974 | Winters et al. | 404/72 |
| 3,919,148 | 11/1975 | Winters et al. | 260/28.5 AS |

*Primary Examiner*—Lewis T. Jacobs

*Attorney, Agent, or Firm*—Fulwider, Patton, Rieber, Lee & Utecht

[57] ABSTRACT

The paving material comprises the reaction product formed by heating a mixture of paving grade asphalt and a non-oil resistent rubber to a temperature of about 350° F to about 500° F. The improvement provides for a relatively low viscosity paving material by admixing a diluent with the asphalt-rubber mixture prior to the reaction whereby the viscosity of the paving material is unexpectedly reduced to about one-half as compared to the viscosity of the reaction product having the diluent admixed after the formation thereof. Variations in the viscosity of the paving material are unexpectedly minimized by precuring the asphalt-rubber-diluent mixture prior to reaction thereof.

12 Claims, No Drawings

LOW VISCOSITY ASPHALT-RUBBER PAVING MATERIAL

BACKGROUND OF THE INVENTION

1. Field of the Invention

This invention is in the field of paving compositions comprising the jellied product formed by reacting asphalt and rubber, and which is the subject of applicant's U.S. Pat. Nos. 3,844,668, 3,891,585, and pending United States application Ser. Nos. 622,143, filed Oct. 14, 1975 now U.S. Pat. No. 4,021,303, and 584,478, filed on June 6, 1975 now U.S. Pat. No. 4,018,730.

2. Description of the Prior Art

Paving compositions manufactured by reacting asphalt and rubber are significant improvements over prior paving materials, and constitute a new use for hitherto unwanted scrap rubber, such as old tires. In manufacturing these compositions, the asphalt and rubber are mixed and heated to a temperature range between about 350° to about 500° F until the desired reaction takes place. While the asphalt-rubber mixture is heated to the desired reaction range, the viscosity of the mixture continues to decrease as the temperature increases until the reaction temperature range is reached whereupon the viscosity increases as the reaction temperature increases.

Equipment designed for handling and applying paving material, such as by spraying, requires that the viscosities of the paving material not exceed 3,500 to 4,000 centipoise. The viscosity of the asphalt-rubber reaction product is generally much greater than that, and must be reduced by admixing diluents, such as kerosene, by using a relatively coarse rubber, by regulating the ratio of rubber to asphalt, or by using a less viscous grade of asphalt.

SUMMARY OF THE INVENTION

It has been discovered, that if a given amount of diluent is added directly to the asphalt-rubber mixture prior to the reaction which forms the jellied reaction product, the viscosity of the reaction product, contrary to expectations, will be reduced by at least 50% as compared to the viscosity of the reaction product having the same amount of diluent admixed after the reaction has occurred.

It has further been discovered that by preheating the asphalt-rubber-diluent mixture to a temperature between about 200° to about 280° F for at least about 3 hours prior to reacting the mixture to produce the jellied reaction product, the viscosity of the jellied reaction product will be relatively uniform, an unanticipated result. Without the preheating step as aforesaid, viscosities of jellied reaction products have been observed to vary over a relatively wide range which has caused some difficulty in handling the reaction product in the distribution equipment.

The aforesaid discoveries are indeed surprising because one skilled in the art would expect that admixing a diluent after the asphalt-rubber reaction would be more effective in reducing the viscosity of the reaction product as compared to admixing a diluent before said reaction where the diluent might be consumed by the reaction or boil-off when the mixture is heated to the reaction temperature. The applicant, however, has discovered that the reverse is true, i.e., that viscosities of asphalt-rubber reaction products are reduced by at least one-half or more if the diluent is premixed with the asphalt-rubber mixture prior to reaction.

DESCRIPTION OF THE PREFERRED EMBODIMENT

The jellied reaction product is prepared pursuant to the procedures set forth in applicant's U.S. Pat. Nos. 3,844,668 and 3,891,585. In brief, these procedures require that the asphalt and rubber be mixed together and heated to the temperature range of about 350° to about 500° F where the desired reaction takes place. Pursuant to the present invention, however, a diluent, such as kerosene, is premixed with the rubber and asphalt prior to heating to said reaction range. The ratio of asphalt to rubber is in the approximate range of about 2 to about 5 parts of asphalt for every part of rubber.

All paving grade asphalts from penetration grade 10—10 through 200–300, which includes Pacific Coast users viscosity gradations AR-1000 to 16,000 are suitable for practicing the invention.

Hydrocarbon rubbers are used in the present invention. By the term "hydrocarbon rubbers" is meant non-oil resistant asphalt-soluble rubbers. Non-oil resistant asphalt-soluble rubbers are those rubbers that are partially soluble to the extent from about 2 to about 12 percent by weight in asphalt and are attacked by, react with, or are affected by oils, such as lubricating oils, hydraulic oils and the like. Suitable rubbers that can be employed include unvulcanized, vulcanized or reclaimed rubbers including natural rubber, (NR, polyisoprene polymer), isoprene rubber (IR, polyisoprene polymer), butadiene rubber (BR, polybutadiene polymer), butadiene-styrene rubber (SBR, butadiene-stryrene copolymer) butyl rubber (IIR, the isobutylene isoprene polymer) and ethylenepropylene rubber (EPM and EPDM, ethylene propylene copolymers and terpolymers which are unvulcanized, vulcanized or reclaimed.

The reclaimed rubber can be devulcanized or partially devulcanized and can be prepared from vulcanized or unvulcanized rubber by the digester process, Heater or Pan process, high pressure steam process, Lancaster-Banbury process, Reclaimator or other conventional reclaiming processes (Maurice Morton, *Introduction to Rubber Technology,* Van Nostrand Reinhold Co., New York, 1959, pps. 404–435). Normally the reclaimed rubber will be prepared from old, worn tires, tire scrap, innertube scrap, retread scrap, tire peel, tire carcass, rubber buffings and other rubber scrap.

In practice, other types of rubbers, that is, oil resistant and/or non-asphalt soluble rubbers have not been found suitable for preparing the hot elastomeric pavement repair material. For example, rubbers which have not been found suitable for the composition are: nitrile (NBR, butadiene acrylonitrile copolymers), epichlorohydrin (ECO, epichlorohydrin polymer and copolymer), neoprene rubber (CR, chloroprene polymers), hypalon (CSM, chloro-sulfonated polyethylene (polymers), urethane rubber (AU, EU, urethane polymers or elastomers), polysulfide or thiokol rubber (T, organic polysulfides), silicone rubber (Si, organic silicone polymers), fluoro silicone rubber (FSi, fluorinated organic silicone polymers), fluoro elastomer (FTM, fluorocarbon polymers), acrylic rubbers and polyacrylates (ACM, copolymers of acrylic ester and acrylic halide). These rubbers have been found to be unsuitable for the present invention because they do not react in the desired manner with asphalt under the described conditions to form the required jellied composition.

The following types of rubbers are preferred for use in the invention: (1) ground whole tire rubber (with and without carcass fabric residue); (2) unprocessed rubber buffings, this is rubber buffings that have not been subject to devulcanization or reclaiming processes (a by-product of tire retreading); (3) ground innertubes (natural rubbers and synthetic butyl rubbers); (4) reclaimed rubber; (5) partially devulcanized reclaimed rubber; and (6) asphalt soluble rubber. The range particle size for the rubber is from about 4 mesh to about minus 200 mesh USS, and the preferred particle size is a size that will pass through a 20 mesh and be retained on a 200 mesh USS. Unprocessed rubber refers to rubber that has not been chemically or thermally altered. Unprocessed rubber includes rubbers that have been ground, screened, decontaminated, and treated to remove metals, cord and fabric therefrom.

A diluent is premixed with the asphalt-rubber mixture in amounts between about 1 percent to about 15 percent by weight of the asphalt-rubber mixture, and preferrably within a range of 2 to 7 weight percent. Exemplary of diluents contemplated by the present invention are kerosene, the petroleum fractions from crude oil distilled at a temperature from between about 174° to about 325° 1 C, or any other equivalent organic solvent which is recognized in the art for purposes of reducing the viscosity of asphalt. Maltenes, which are used to improve the low temperature flexing properties of the paving composition described herein, may be considered to be a "diluent", but they are not included within the term "diluent" as used herein because maltenes do not have the same effect on viscosity as does kerosene as described herein.

EXAMPLES

To demonstrate the effect of premixing a diluent and precuring the asphalt-rubber-diluent mixture as aforesaid, seven batches of an asphalt-rubber mixture were prepared and are referred to as numbers 289, 291, 292, 293, 294, 295, and 296. The composition of each batch is set forth in Table I.

Each batch was prepared by mixing asphalt and discarded vehicle tires ground to various sizes, and heating the mixture to about 170° F to produce a homogeneous batch. A maltene was added to the first six batches to improve low temperature flexing properties. Each batch, except for 296, was thereafter divided into 3 portions, "A", "B", and "C".

The "A" portions were heated to react the asphalt and rubber and produce a viscous jellied reaction product. Kerosene was added to the reaction product to reduce its viscosity.

The "B" portions were premixed with the same amount, or less of kerosene as in the "A" portion and the resultant mixtures were heated to produce a jellied reaction product having a viscosity that was one-half (½) or less than the viscosity of the "A" portion.

The "C" portions were premixed with the same amount, or less of kerosene as in the "A" and "B" portions, and the resultant mixture was preheated before elevating the temperature to produce a jellied reaction product. In every "C" portion, except for one, the resultant viscosity was less than one-half (½) of the viscosity of the "A" portion.

The comparative viscosities in centipoises of the "A". "B", and "C" portions of each batch are set forth in Table II.

TABLE I

| Batch | Number of parts of rubber and grade of rubber | Number of parts of asphalt and grade of asphalt | Weight percent of maltene based on weight of asphalt-rubber mixture and type of maltene | Weight percent of kerosene, based on weight of each "A", "B" and "C" portion, which was added to each "A", "B" and "C" portion of each batch |
|---|---|---|---|---|
| 289 | 19 parts of TP 0.0165 | 81 parts of AR 1000 | 5% of Dutrex 739 | 7% |
| 291 | 19 parts of TP 0.044 | 81 parts of AR 8000 | 5% of Dutrex 739 | 11% of kerosene to the "A" portion<br>5% of kerosene to the "B" and "C" portion |
| 292 | 15 parts of TP 100 | 85 parts of AR 1000 | 5% of Dutrex 739 | 5% |
| 293 | 25 parts of TP .033 | 75 parts of AR 1000 | 5% of Docal 166 | 10% |
| 294 | 30 parts of TP .074 | 70 parts of AR 1000 | 5% of Docal 166 | 2% |
| 295 | 19 parts of TP .033 | 81 parts of AR 1000 | 2% of Dutrex 739 | 11% of kerosene to the "A" portion<br>5% of kerosene to the "B" and "C" portion |
| 296 | 19 parts of TP .0165 | 81 parts of AR 1000 | None | 7% |

TABLE II

| Batch | Viscosity of "A" portion at 350° F after adding kerosene | Viscosity of "B" portion at 350° F having premixed kerosene | Viscosity of "C" portion at 350° F having premixed kerosene and after mixture was precured at about 220° F for about 3 hours |
|---|---|---|---|
| 289 | 8,000 | 4,000 | 2,700 |
| 291 | 1,600 | 480 | 900 |
| 292 | 400 | 150 | 150 |
| 293 | 14,000 | 5,400 | 5,000 |
| 294 | 8,000 | 3,400 | 3,000 |
| 295 | 4,500 | 1,600 | 2,200 |
| 296 | 8,000* | 3,400 | 3,800 |

*From Batch 289 which is identical to Batch 296 except for the absence of 5% of Dutrex 739 which has a negligible effect on viscosity.

The "TP" designation in Table I stands for ground tire peel. The numbers after the TP designation represents the particular U.S. Standard mesh size of the ground tire peel in accordance with the following schedule;

TP 0.0165 — will pass through a No. 40 size screen

TP. 0.044 — will pass through a No. 16 size screen be retained by a No. 25 size screen TP 100 — will pass through a No. 100 size screen TP 0.033 — will pass through a No. 20 size screen be retained by a No. 40 size screen TP 0.074 — will pass through No. 10 size screen be retained by a No. 16 size screen The "AR 1000" designation represents a viscosity grading system used in the uniform Pacific Coast asphalt specifications and is a standard designation in the asphalt trade.

Dutrex and Docal are the tradenames of the Shell Oil Company of California and the Douglas Oil Company of California, respectively, for maltenes.

The following procedure was followed in heating the "A", "B", and "C" portions. The "A" portions were heated at a constant rate up to a temperature between 390° and 410° F over a period of about 1 to 2 hours. Thereafter, heating was discontinued and the temperature of the "A" portions were allowed to drop to 350° F whereupon kerosene was admixed therewith and the "A" portions were heated to 350° F at which temperature viscosity measurements were taken.

The "B" portions were heated in the same manner as the "A" portions except for the premixing of kerosene before heating to 390° to 410° F. No additional kerosene was added thereafter.

The "C" portions were heated in the same manner as the "B" portions except that the mixture was precured, i.e., heated to about 220° F for about 3 hours and then heated to 390° to 410° F. No additional kerosene was added thereafter.

Precuring of the mixture is carried out at a preferred temperature range of between about 200° to about 250° F for 5 hours. However, a precuring temperature range of between about 200° to about 280° F at a minimum of 3 hours will also produce satisfactory results.

While the embodiment of the invention chosen herein for purposes of disclosure is at present to be considered preferred, it is to be understood that this invention is intended to cover all changes and modifications in the disclosed embodiment which fall within the spirit and scope of the invention.

I claim:

1. In a method for surfacing and repairing broken pavement with an elastomeric paving material, said material comprised of reaction product formed by endothermically reacting a mixture of a paving grade asphalt and a non-oil resistant rubber, the improvement comprising the step of admixing at least one diluent selected from the group consisting of petroleum fractions distilled from crude oil at a temperature of from about 174° to about 325° C. with said asphalt and said rubber prior to forming said reaction product, said diluent being admixed in an amount of from about 1 to about 15 percent by weight of said asphalt-rubber mixture, whereby the viscosity of said reaction product is reduced to at least about one half as compared to the viscosity of said reaction product having said diluent admixed after the formation thereof.

2. In the method as defined in claim 1, and further comprising the step of preheating the asphalt-rubber-diluent mixture to a temperature of between about 200° and 280° F. for at least about 3 hours prior to forming the reaction product, whereby the viscosity of said reaction product is made relatively uniform as compared to the viscosity of said reaction product manufactured in the absence of said preheating step.

3. The method as defined in claim 1 wherein said diluent is admixed in an amount of from about 2 to about 7 percent by weight of said asphalt-rubber mixture.

4. The method as defined in claim 2 wherein said diluent is admixed in an amount of from about 2 to about 7 percent by weight of said asphalt-rubber mixture.

5. The method as defined in claim 1 wherein said diluent is kerosene.

6. The method as defined in claim 2 wherein said diluent is kerosene.

7. An elastomeric paving material comprised of a reaction product of a paving grade asphalt, a non-oil resistant rubber, and an asphalt solvent;

said material being prepared by mixing from about 2 to about 5 parts by weight of paving grade asphalt, about 1 part by weight of particulate non-oil resistant asphalt soluble rubber, and at least one diluent selected from the group consisting of petroleum fractions distilled from crude oil at a temperature of from about 174° to about 325° C., said diluent being admixed in an amount of from about 1 to about 15 percent by weight of the asphalt-rubber mixture;

and heating said asphalt-rubber-diluent mixture to a temperature of from about 350° to about 420° F. to form a jellied reaction product, whereby the viscosity of said reaction product is reduced to at least about one half as compared to the viscosity of said reaction product having said diluent admixed after the formation thereof.

8. The elastomeric material as defined in claim 7 wherein said asphalt-rubber-diluent mixture is preheated to a temperature of from about 200° to about 280° F. for at least 3 hours prior to forming said reaction product, whereby the viscosity of said reaction product is made relatively uniform as compared to the viscosity of said reaction product manufactured in the absence of said preheating step.

9. The elastomeric material as defined in claim 7 wherein said diluent is admixed in an amount of from about 2 to about 7 percent by weight of said asphalt-rubber mixture.

10. The elastomeric material as defined in claim 8 wherein said diluent is admixed in an amount of from about 2 to about 7 percent by weight of said asphalt-rubber mixture.

11. The elastomeric material as defined in claim 7 wherein said diluent is kerosene.

12. The elastomeric material as defined in claim 8 wherein said diluent is kerosene.

* * * * *